US007040401B1

(12) United States Patent
McCannon

(10) Patent No.: US 7,040,401 B1
(45) Date of Patent: May 9, 2006

(54) AUTOMATED PLUNGER CATCHER AND RELEASER AND CHEMICAL LAUNCHER FOR A WELL TUBING METHOD AND APPARATUS

(75) Inventor: James Merl McCannon, Elk City, OK (US)

(73) Assignee: Samson Resources Company, Tulsa, OK (US)

( * ) Notice: Subject to any disclaimer, the term of this patent is extended or adjusted under 35 U.S.C. 154(b) by 212 days.

(21) Appl. No.: 10/813,771

(22) Filed: Mar. 31, 2004

(51) Int. Cl.
*E21B 43/12* (2006.01)

(52) U.S. Cl. ..... 166/250.15; 166/53; 166/68; 166/70; 166/75.15; 166/310; 166/372; 417/56

(58) Field of Classification Search ..... 166/250.15, 166/372, 53, 66, 68, 70, 75.15, 310; 417/56
See application file for complete search history.

(56) References Cited

U.S. PATENT DOCUMENTS

| | | | | |
|---|---|---|---|---|
| 2,878,754 A | | 3/1959 | McMurry | 103/52 |
| 3,051,242 A | | 8/1962 | Chamberlain et al. | 166/185 |
| 3,090,316 A | * | 5/1963 | Montgomery | 166/372 |
| 4,629,004 A | * | 12/1986 | Griffin | 166/372 |
| 4,693,308 A | | 9/1987 | Luke et al. | 166/55.1 |
| 4,898,235 A | * | 2/1990 | Enright | 166/64 |
| 4,984,969 A | | 1/1991 | Fineberg | 417/58 |
| 5,957,200 A | * | 9/1999 | Majek et al. | 166/250.15 |
| 5,984,009 A | | 11/1999 | DiFoggio | 166/250.13 |
| 6,032,733 A | | 3/2000 | Ludwig et al. | 166/60 |
| 6,688,385 B1 | * | 2/2004 | Moe | 166/53 |
| 6,719,060 B1 | * | 4/2004 | Wells | 166/372 |
| 6,907,926 B1 | * | 6/2005 | Bosley | 166/108 |
| 6,935,427 B1 | * | 8/2005 | Billingsley | 166/301 |
| 2002/0074118 A1 | * | 6/2002 | Fisher | 166/250.15 |

OTHER PUBLICATIONS http://www.weatherford.com/weatherford/groups/ public/ documents/artificiallift/pl_lubricators.hcsp.
Introduction to Plunger Lift: Application, Advantages and Limitations; by E. Beauregard and Paul L. Ferguson, Ferguson Beauregard, 1981.

* cited by examiner

*Primary Examiner*—Hoang Dang
(74) *Attorney, Agent, or Firm*—Head, Johnson & Kachigian

(57) ABSTRACT

An automated plunger catcher and releaser and chemical launcher for a well tubing method and apparatus. In one configuration, arrival of a plunger is sensed as the plunger ascends from the wellbore through the production tubing and a signal is sent to a controller. A signal is sent from the controller to actuate a stem in order to hold the plunger in a surface catcher chamber. A flowline is thereafter closed by signal from the controller in order to stop fluid flow through the production tubing. A signal is sent from the controller to an actuated valve on a chemical launcher, thereby opening the valve and releasing chemical. Thereafter, the valve is closed to stop release of chemical. The plunger is held in position for a predetermined time and then the stem is retracted in order to permit the plunger to fall by gravity. Finally, the flowline is opened in order to permit fluid flow therethrough and the process is sequentially repeated as desired.

16 Claims, 4 Drawing Sheets

Prior Art

AUTOMATED PLUNGER CATCHER AND RELEASER AND CHEMICAL LAUNCHER FOR A WELL TUBING METHOD AND APPARATUS

BACKGROUND OF THE INVENTION

1. Field of the Invention

The present invention relates to an automated method and apparatus to catch and release a plunger which reciprocates in a production tubing of a well wherein the plunger and catcher operate in conjunction with opening and closing of a flowline. The present invention additionally relates to an automated method and apparatus to catch and release a plunger which reciprocates in a production tubing having an automated chemical launcher which operates in conjunction with the catcher and releaser.

2. Prior Art

Wells that produce natural gas very often also produce liquids, such as oil or water. Natural gas and liquids flow into the wellbore due to the pressure inside the wellbore being less than the pressure in the underground reservoir. This differential pressure is often referred to as "drawdown". If the flow rate of natural gas is high enough, the liquids are swept upward and continuously removed from the wellbore by the velocity of the natural gas. However, as the well ages, the flow rate of the natural gas will often decrease to the point where the velocity is insufficient to continuously remove these liquids from the wellbore. As the liquid "falls back", a liquid fluid level begins to form in the wellbore. This liquid level exerts a hydrostatic pressure. As the liquid level (and the hydrostatic pressure) increase, the pressure inside the wellbore at the formation face begins to increase. Since flow from the reservoir into the wellbore is governed by the differential pressure between the reservoir and the wellbore, an increase in pressure due to this fluid column reduces the flow from the reservoir. This is referred to "liquid loading". Once the hydrostatic pressure caused by the fluid column inside the wellbore equalizes with the pressure in the reservoir, flow from the reservoir decreases to zero. The well is then referred to as being "loaded up".

To alleviate this "loaded up" condition, various forms of "artificial lift" exist. "Artificial lift" includes the many methods that allow a well to be produced after natural flow has ceased from a well. One such form of artificial lift is "plunger lift". Plunger lift is a form of artificial lift whereby a "plunger" or piston is utilized to provide a solid interface between the natural gas and the fluid so as to prevent the liquid from falling back and accumulating in the reservoir. Examples of plungers are seen in McMurry (U.S. Pat. No. 2,878,754) and Fineberg (U.S. Pat. No. 4,984,969). The plunger itself comes in various sizes and designs but in general is a cylindrical metal object that has a diameter that is slightly smaller than the internal diameter of the well's production tubing. This close tolerance in diameters allows the plunger to reciprocate up and down the length of the tubing, but the tolerance is close enough that fluid that accumulates in the tubing is swept upward by the plunger. Plunger lift is a form of "intermittent" artificial lift so designated because the well is cycled through intermittent periods of being shut in and then opened up for production. These cycles of shut-in/production are controlled automatically with valves and controllers typically supplied as part of the overall plunger lift installation.

The general operation of existing plunger lift systems may be observed from FIG. 1 as follows:

1) A spring (not shown) is installed in the bottom of the production tubing (not shown) downhole below the surface 8 to cushion the fall of the plunger 12 and prevent it from falling out the bottom of the tubing (not shown).

2) Surface equipment, above a wellhead 14, is installed on the well as follows:

a. A catcher 16 is installed onto a tubing extension 10 above the wellhead valve connection 14 to provide a hollow receptacle for the plunger 12 when it arrives at the surface. The receptacle may sometimes broadly be referred to as a lubricator—an equalizing chamber to introduce something in a pressurized system. Integral to this catcher/lubricator 16 is a manually operated "catcher" mechanism 18 which can be set to prevent the plunger 12 from falling back down the tubing. This manual catcher provides a means for the plunger to be held at the surface for subsequent retrieval by an operator. The catcher mechanism must be armed to activate by the operator and also manually reset by the operator.

b. A controller 20 is used to control actuation of various valves in the system. Most commonly, the controller 20 actuates opening and closing of a flowline valve 22 by sending a signal to a switch such as a micro pressure switch 24 connected to the flowline valve 22. The valve may be actuated by gas pressure on a diaphragm or another mechanism. This flowline valve is the mechanism by which the well is either shut in or opened to flow.

c. Commonly installed onto the catcher 16 is a plunger arrival detection switch 26 that detects the arrival of the plunger into the lubricator. Upon detection of the plunger 12, this switch 26 sends a signal to the controller 20, where this information is stored.

3) Upon initial installation, the plunger 12 is installed in the lubricator/catcher 16 and allowed to fall by gravity to the spring at the bottom. There is enough tolerance in diameters that the plunger 12 will fall through fluid that has accumulated in the tubing.

4) The well is then shut in at the surface using the flowline valve 22 and pressure is allowed to build up in the well.

5) The surface controller 20 can be programmed to open and close the flowline valve 22 based on numerous parameters such as time or pressure. Upon reaching the set parameter, the flowline valve 22 is opened. Since pressure has built on the well, flow occurs in the direction shown by arrow 28 from the wellbore through the open flowline valve 22. The plunger 12 ascends from the bottom of the tubing, driven by the gas pressure below it. The plunger 12 travels at a high velocity and its close tolerance allows minimal fluid to slip past the plunger 12 as it travels up tubing, pushing a column of fluid ahead of it. The fluid is removed from the tubing through the flowline as the plunger 12 arrives at the surface. Flow is allowed to continue until the controller 20 senses a programmed parameter (such as time or pressure) at which time the controller 20 signals the flowline valve 22 to close and the well is shut in. When the flow in the tubing decreases, gravity acting on the weight of the plunger 12 allows it to fall back down the production tubing to the spring on bottom and the cycle is repeated.

The reciprocating plunger also serves a secondary purpose of periodically cleaning the production tubing of paraffin buildup on paraffinic oil wells.

The application of chemicals to wells is also a common, known practice. These chemicals can be applied in liquid form on a continuous basis by use of a chemical pump or can be applied in solid form by use of solid chemical formed into stable, solid "sticks".

The nature of these chemicals, whether in liquid or solid form, can vary and includes:

Surfactants (commonly known as "soap" or "foamer"): Applied to natural gas wells to reduce the surface tension of produced water, creating a lower density "foamed" fluid. This lower density "foamed" fluid column exerts less of a hydrostatic pressure than a pure liquid fluid column. This results in several benefits to the well: 1.) The reduced hydrostatic pressure results in an increased "drawdown" on the well, resulting in an increase in the well's gas flow rate; 2.) The lower density "foamed" fluid column is more easily removed from the wellbore by the flowing gas stream.

Corrosion Inhibitors: Applied to natural gas wells and oil wells to provide a protective "film" on the walls of the well's tubulars, thereby inhibiting attack on the tubulars from corrosive wellbore fluids.

Scale Inhibitors: Applied to natural gas wells and oil wells to chemically inhibit the formation of scale products that form downhole.

Other Chemicals: Other chemicals sometimes applied to natural gas and oil wells include methanol (for the control of hydrates) and paraffin solvents/dispersants (for the control of paraffin products).

Applying chemicals, whether in liquid or solid form, down the production tubing of a flowing natural gas well requires the flow to either be shut-in, or at minimum, to be at a rate low enough to allow the chemicals to fall down the tubing by the force of gravity. If the flow of natural gas and fluids from the well up the tubing is too great, the force of this flow would tend to sweep the chemicals out of the tubing, thereby preventing effective application of the chemicals.

It is known to apply chemicals to natural gas wells in the following manner:

A chemical injector "launcher" is installed on top of the wellhead. This launcher typically consists of a valve arrangement with a pipe chamber ("lubricator") designed to hold solid chemical sticks. This lubricator is used to apply solid chemical sticks to the well's tubing during periods when the well is shut-in. This is a manual process requiring action by the lease operator to load the lubricator with chemical sticks and apply them to the well's tubing by opening the valve arrangement and allowing the chemical sticks to fall down the well's tubing by the force of gravity.

An improvement to the above process is an automated chemical stick launcher 30, depicted in the diagram in FIG. 2. This assembly typically consists of a lubricator 32 designed to hold several chemical sticks 34 and an automated valve mechanism 36 designed to apply one or more sticks 34 to the wellbore tubing automatically. The automated valve mechanism 36 is actuated by a controller 38 programmed to actuate the valve 36 on various pre-programmed parameters such as time or pressure. The controller communicates with a switch, such as a micro pressure switch 40 to actuate the valve mechanism 36. The controller 38 is designed to apply the sticks 34 by actuating the opening and closing of the automated valve 36, thereby allowing one or more of the chemical sticks to gravity fall down the well's tubing. There are numerous automated chemical stick launchers in use throughout the industry. In every case, the chemical launcher is in line and aligned with the production tubing at the surface of the well head.

Currently, no mechanism currently exists to automatically catch and release a plunger. Accordingly, it would be desirable to provide an automated plunger catcher and releaser assembly.

Since plunger lift equipment and chemical stick launchers (whether manual or automatic) both require installation on top of the wellhead, it is prohibitive to use these technologies simultaneously. Accordingly, it would be desirable to provide a method and apparatus for a plunger catcher/releaser which could be installed and operate in sequence with a chemical launcher.

SUMMARY OF THE INVENTION

The present invention is directed to both a process and an apparatus for an automated plunger catcher and releaser and a chemical launcher to apply chemicals to the well's production tubing ahead of the plunger fall.

In one preferred process, a plunger arrival sensor switch in the form of a magnet metal sensor detects arrival of the metal plunger as it ascends from below the surface and a signal is sent to a controller. Upon receipt of this signal, the controller sends a signal to a switch which communicates with an actuator to move a stem towards the plunger lubricator. The stem engages and applies a force to a spring mechanism and ball, thereby holding the plunger in the catcher lubricator and preventing its fall by gravity.

The controller actuates closing of a flowline valve based on program parameters and the well flow ceases.

Once the flowline valve closes, the controller sends a signal to an actuated valve on an automatic chemical ball launcher assembly. This signal causes the valve on the chemical ball launcher assembly to open, thereby, launching a preset number of chemical balls out of the launcher and down the well's tubing. The valve will remain open for a set period of time. Upon releasing its preset number of chemical balls, the actuated valve on the chemical ball launcher closes. The chemical balls released will roll and fall by gravity down the well's tubing downhole.

The plunger is meanwhile held in the automatic plunger catcher/releaser mechanism for a preprogrammed amount of time and is held while the chemical is being released. Once the preprogrammed time expires, the controller sends a signal to an actuator which causes the actuator to move the stem away from the plunger lubricator. When the modified stem moves away from the plunger lubricator, the catcher spring and ball mechanism is de-energized, thereby releasing the plunger which falls back down the production tubing by force of gravity.

A signal is thereafter sent from the controller to a switch to open the flowline valve so that the plunger begins to return to the surface with fluid flow and the cycle is repeated.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 3:
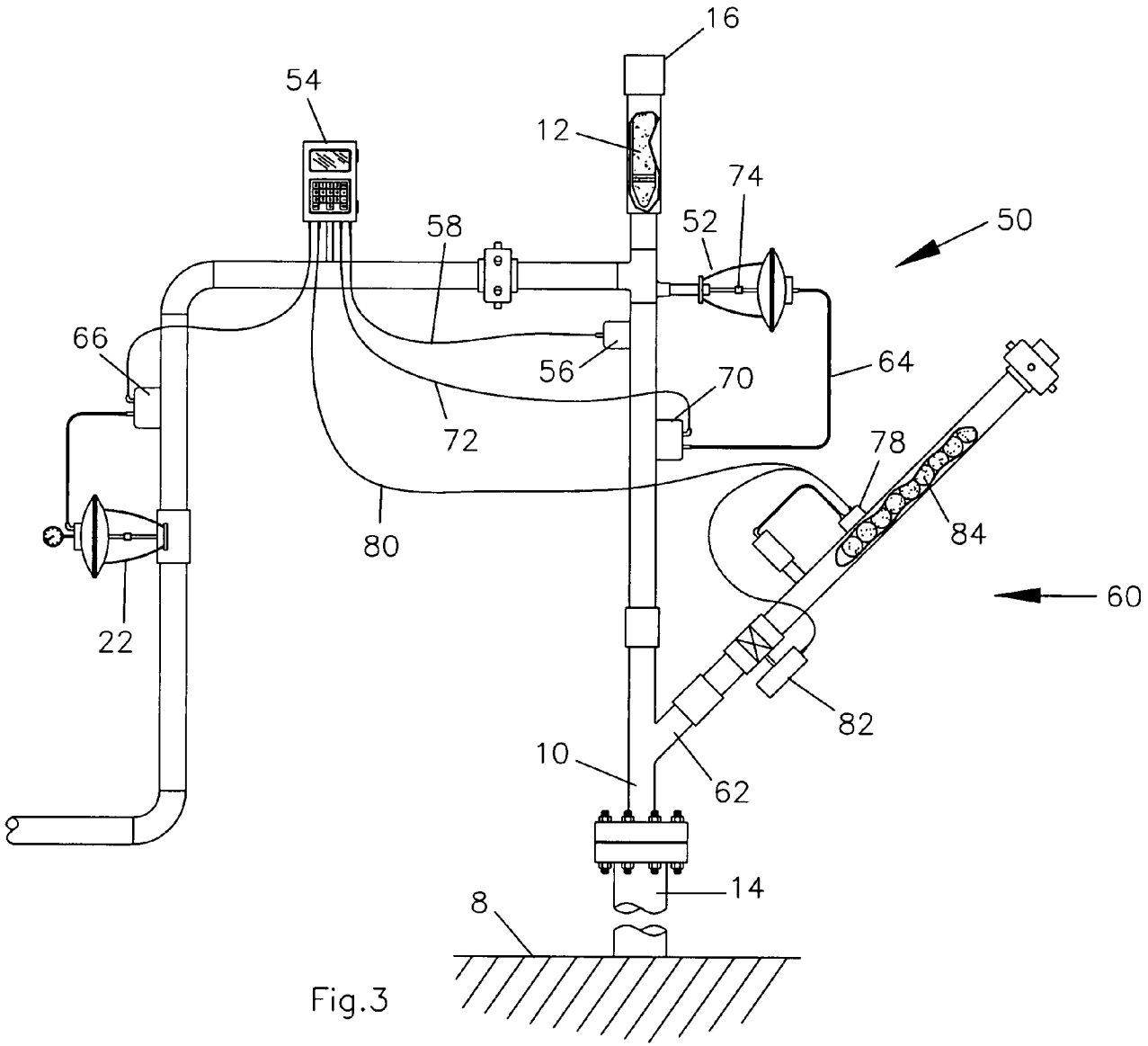
FIG. 3 is a diagrammatic view of an automated plunger catcher and releaser and chemical launcher method and apparatus constructed in accordance with the present invention.

Referring to the drawings in detail, FIG. 3 illustrates a simplified diagrammatic view of an automatic plunger catcher and releaser assembly and combining this with an apparatus and a process to automatically apply chemicals to the well's tubing ahead of the plunger fall.

Figure 1:
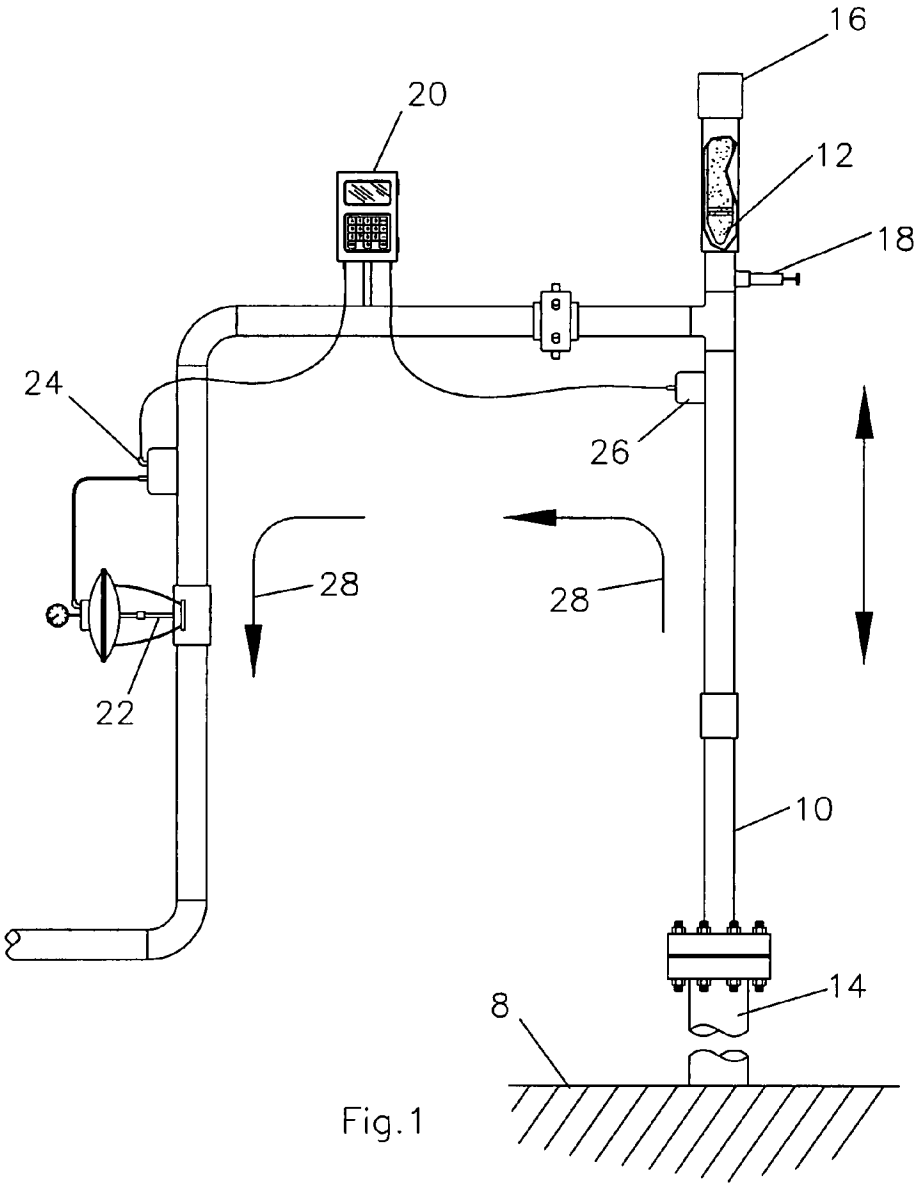
FIG. 1 is a simplified schematic diagram of an existing known, prior art manual catch and release mechanism for a plunger operating in a well.
Figure 2:
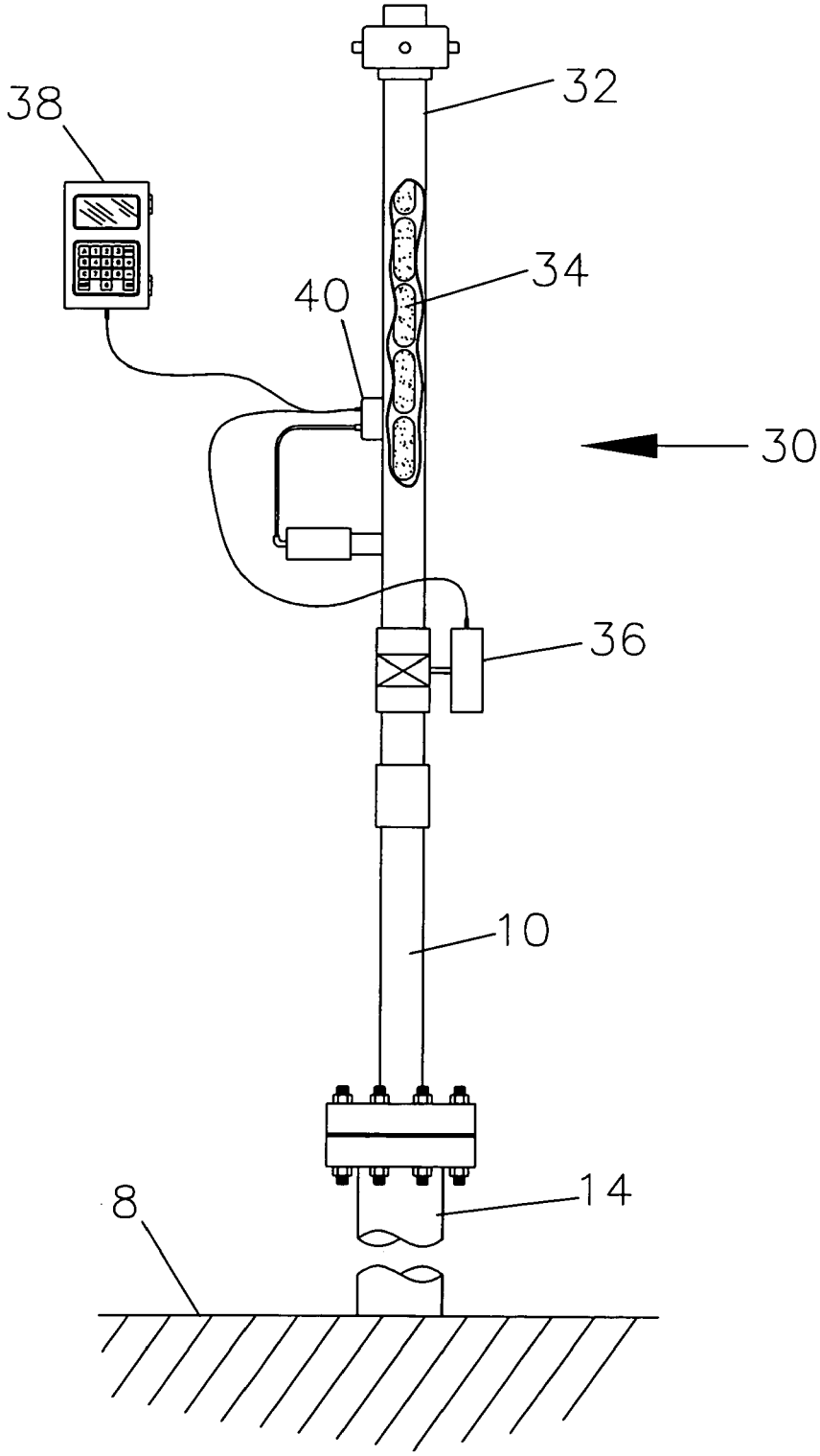
FIG. 2 is a known, prior art chemical launcher used to launch chemical into a well tubing of a well.
Figure 4:
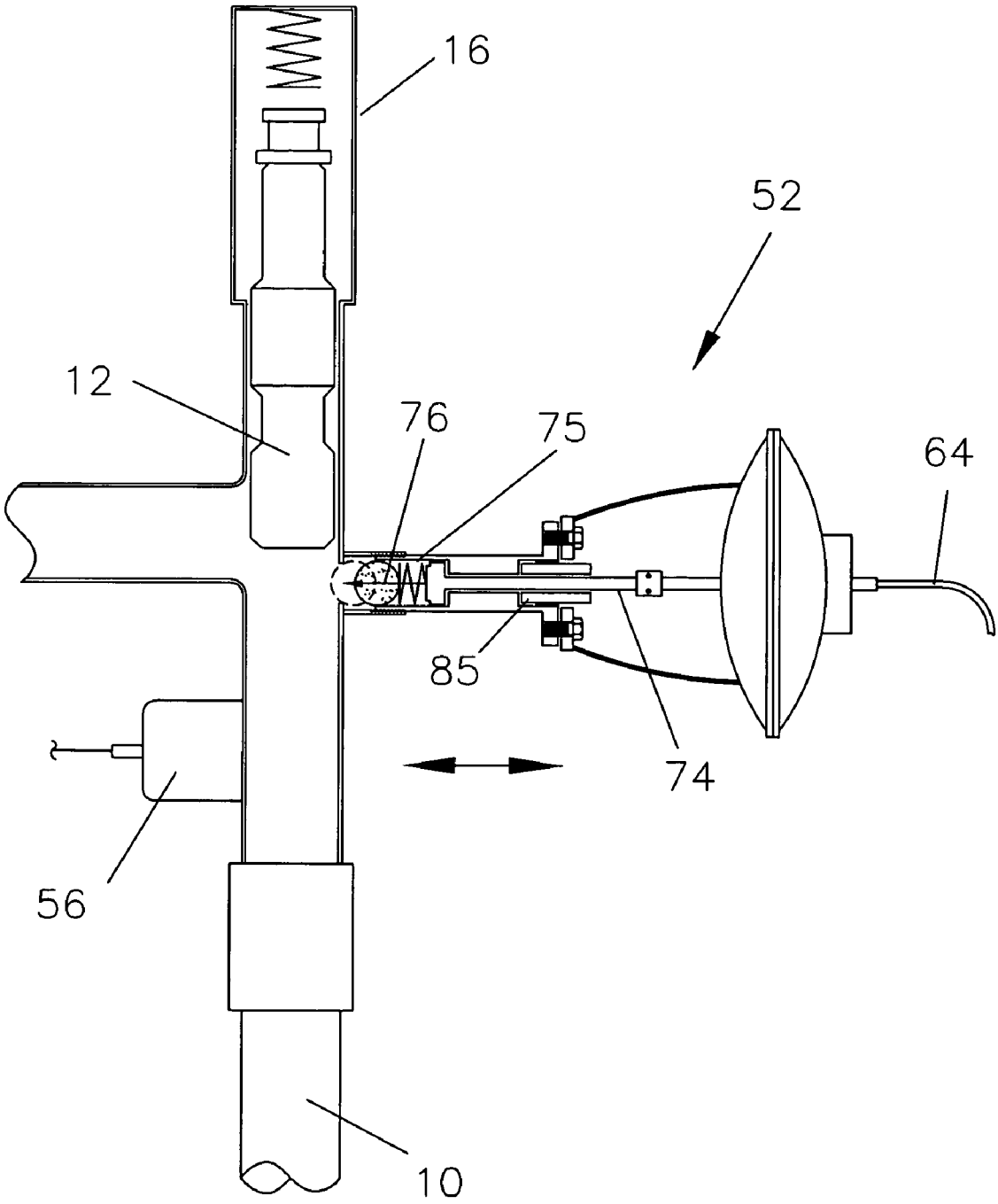
FIG. 4 is an enlarged view of an actuator portion of the automated plunger catcher and releaser shown in FIG. 3 constructed in accordance with the present invention.

As described herein, the present invention includes an automated plunger catcher and releaser assembly 50 constructed by modifying existing components to convert a standard manual plunger catcher mechanism to an automatic mechanism which can both catch and release the plunger. This is achieved by modifying the manual catch by installing an actuator 52 with a modified stem and adapter arrangement onto the standard manual catcher described in FIG. 1. An enlarged view of the actuator 52 partially cut away is depicted in FIG. 4. The actuator 52 can be actuated by parameters programmed into a controller 54, such as a set time period or pressure. The controller may be a software driven electronic controller as are well known in the arts. The actuator 52 can be actuated to both catch and release the plunger 12 based on logic programmed into the controller 54.

As described herein, the present invention also includes an automated chemical launcher assembly 60 constructed by modifying existing components to allow the automatic chemical launcher to be used simultaneously with plunger lift equipment. This is achieved by modifying the installation from one that is typically vertically installed on top of the wellhead to one that is installed in angular relation to the axis of the production tubing on the wellhead. Additionally, the automatic chemical stick launcher utilizes the controller 54 to actuate the valve on the automatic chemical stick launcher 82 based upon logic programmed into the controller. Additionally, the chemicals were modified from stick form to a round, ball form 84 to facilitate application by gravity on a 45 degree angle.

As a result of the present invention, a mechanism has been devised to allow automated, simultaneous use of plunger lift and the application of chemicals down the production tubing.

The automatic plunger catcher/releaser assembly 50 is installed onto a standard plunger lubricator/catcher receptacle assembly 16 on top of the wellhead 14.

An automatic chemical ball launcher 60 is installed by installing a 45 degree weld connection 62 below the plunger catcher/releaser assembly 50. A threaded nipple (not visible) is installed onto the 45 degree connection 62 allowing the automatic chemical ball launcher 60 to be installed onto the nipple.

The controller 54 is wired and programmed to actuate both the automatic plunger catcher/releaser assembly 50 and the automatic chemical ball launcher 60 as follows.

The following steps describe the process associated with the present invention. A plunger arrival sensor switch 56 in the form of a magnetic metal sensor detects the arrival of the metal plunger 12 as it ascends from below the surface 8 and a signal is sent via line 58 to the controller 54.

Upon receipt of this signal, the controller 54 sends a signal to a switch, such as micro pressure switch 70 via line 72. The micro pressure switch 70 communicates with the actuator 52 via line 64 which causes the actuator 52 to move a stem 74 towards the plunger lubricator 16. FIG. 4 illustrates an enlarged view of the actuator 52 which travels in a cylindrical adaptor with a seal such as a stuffing box 85 to prevent fluid escape. When this stem 74 moves towards the plunger, it engages and applies a force to a spring mechanism 75 and ball 76. The ball 76 protrudes into the path of the plunger 12, thereby holding the plunger 12 and preventing its fall by gravity.

The controller 54 actuates the closing of the flowline valve 22 based on programmed parameters. Upon closing of the flowline valve 22, the flow from the well ceases.

Once the flowline valve 22 closes and flow from the well ceases, the controller 54 sends a signal to a switch, such as micro pressure switch 78 via line 80 connected to an actuated valve 82 on the automatic chemical ball launcher assembly. This signal causes the valve 82 on the automatic chemical ball launcher assembly 60 to open, thereby launching a preset number of chemical balls 84 out of the launcher and down the well's tubing. Rather than liquid or solid stick form, the chemical is in the form of solid spheres.

The valve 82 will remain open for a set period of time. Upon releasing its preset number of chemical balls, the actuated valve 82 on the automatic chemical ball launcher assembly 60 closes. The chemical balls released will roll and gravity fall down the well's tubing 10 downhole.

During application of the chemicals, the plunger is retained in the catcher. The plunger 12 is held in the automatic plunger catcher/releaser mechanism 16 for an amount of time pre-programmed into plunger controller 54. In the present example, the plunger is held while the chemical is released. Once this pre-programmed time expires, the controller 54 sends a signal to the micro pressure switch 70 connected to the actuator 52 which causes the actuator to move the modified stem 74 away from the plunger lubricator. When the modified stem 74 moves away from the plunger lubricator, the plunger catcher spring and ball mechanism is de-energized, thereby releasing the plunger. The plunger 12 then falls back down the production tubing by force of gravity.

A signal is thereafter sent from the controller 54 to the micro pressure switch 66, the flowline valve 22 is opened, the plunger 12 begins to return to the surface with fluid flow, and the cycle is repeated.

By providing automatic control of the catch and release of the plunger and the synchronous application of chemicals to the well's tubing ahead of the plunger fall, several advantages are created:

First, chemicals can automatically be applied to the well's tubing in solid form in conjunction with the operation of plunger lift. This allows more efficient application of chemicals such as surfactants, corrosion inhibitors, and other chemicals down the well's tubing without interference with the operation of the plunger lift equipment.

Second, by combining the synchronous application of surfactant or other chemicals down the well's tubing in conjunction with the operation of plunger lift, the well's production rate could be enhanced due to more effective removal of liquids from the wellbore.

Third, by automating the catch and release of the plunger, the operator has more control on the plunger lift operation. The plunger can be held at the surface for a pre-programmed amount of time before being dropped back down the well's tubing.

Whereas, the present invention has been described in relation to the drawings attached hereto, it should be understood that other and further modifications, apart from those shown or suggested herein, may be made within the spirit and scope of this invention.

What is claimed is:

1. An automated method to catch and release a plunger which travels in a production tubing for a well, which method comprises:

sensing arrival of a plunger at a surface catcher chamber and sending a signal to a controller;

sending a signal from said controller to actuate a stem in order to hold said plunger in said surface catcher chamber;

closing a flow line in order to stop fluid flow through said production tubing;

holding said plunger for a predetermined time;

retracting said stem in order to permit said plunger to fall by gravity; and opening said flow line in order to permit fluid flow therethrough.

2. An automated method to catch and release a plunger as set forth in claim 1 including sequentially repeating the process.

3. An automated method to catch and release a plunger as set forth in claim 1 including the additional steps following said closing said flow line of:

sending a signal from said controller to an actuated valve on a chemical launcher;

opening said valve on said chemical launcher, thereby releasing chemical; and actuating said valve to close the release of chemical.

4. An automated method to catch and release a plunger as set forth in claim 3 wherein said chemical launcher is in angular relation to said production tubing.

5. An automated method to catch and release a plunger as set forth in claim 3 wherein said chemical is in the form of solid spheres.

6. An automated method to catch and release a plunger as set forth in claim 1 wherein said plunger is metallic and wherein a magnetic sensor senses said arrival of said plunger.

7. An automated method to catch and release a plunger as set forth in claim 1 wherein said steps of actuating said stem and retracting said stem is performed by actuator activated by gas pressure.

8. An automated method to catch and release a plunger as set forth in claim 1 wherein said stem activates a spring and ball to hold said plunger at the top of said production tubing.

9. An automated method to catch and release a plunger as set forth in claim 1 wherein closing and opening of said flowline is accomplished by a valve and actuator in communication with said controller.

10. An automated method to catch and release a plunger which travels in a production tubing for a well, which method comprises:

sensing arrival of a plunger at a surface catcher chamber and sending a signal to a controller;

sending a signal from said controller to actuate a stem in order to hold said plunger in said surface catcher chamber;

closing the flowline in order to stop fluid flow through said production tubing;

sending a signal from said controller to an actuated valve on a chemical launcher;

opening said actuated valve on said chemical launcher, thereby releasing chemical;

actuating said valve to close release of chemical;

holding said plunger for a predetermined time;

retracting said stem in order to permit said plunger to fall by gravity; and opening said flowline in order to permit fluid flow therethrough.

11. An automated method to catch and release a plunger as set forth in claim 10 wherein said chemical launcher is in angular relation to said production tubing.

12. An automated method to catch and release a plunger as set forth in claim 10 wherein said chemical is in the form of solid spheres.

13. An automated method to catch and release a plunger as set forth in claim 10 wherein said chemical is chosen from the group consisting of surfactants, foams, corrosion inhibitors, scale inhibitors, methanol and paraffin solvents and dispersants.

14. An automated catch and release plunger and chemical application apparatus for a production tubing for a well, which apparatus comprises:

a surface plunger catcher at the top of said production tubing having a stem movable in order to hold said plunger in said surface plunger catcher in response to a signal from a controller;

a valve to close or open a flowline in order to stop or open fluid flow through said production tubing in response to signals from said controller; and a chemical launcher in angular relation to the production tubing wherein a valve actuated by signals from said controller opens said valve to release chemical therefrom and closes said valve to prevent release of chemical therefrom.

15. An automated catch and release plunger and chemical application apparatus as set forth in claim 14 including a magnetic sensor that senses arrival of said plunger at said surface plunger.

16. An automated catch and release plunger and chemical application apparatus as set forth in claim 14 wherein said stem is actuated by gas pressure and wherein said stem activates a spring and ball so that said ball blocks the path of said plunger.

* * * * *